United States Patent [19]

Aagesen

[11] Patent Number: 4,810,245

[45] Date of Patent: Mar. 7, 1989

[54] DEVICE IN CONNECTION WITH A CUP WITH A COVER

[76] Inventor: Tor Ø. Aagesen, Heisel 22, 4700 Vennesla, Norway

[21] Appl. No.: 37,780

[22] Filed: Apr. 13, 1987

[30] Foreign Application Priority Data

Apr. 16, 1986 [NO] Norway ..... 861488

[51] Int. Cl.[4] ..... A61J 7/00

[52] U.S. Cl. ..... 604/78; 222/145

[58] Field of Search ..... 604/78, 247, 256, 189, 604/82–85, 77, 79; 222/129, 145; 220/90.2, 90.4, 20

[56] References Cited

U.S. PATENT DOCUMENTS

| | | | |
|---|---|---|---|
| 240,906 | 5/1881 | Harshman | 222/129 |
| 1,612,615 | 12/1926 | Collins | 222/129 |
| 2,622,420 | 12/1952 | Rice | 604/78 |
| 2,787,267 | 4/1957 | Paiano | 604/78 |
| 3,302,644 | 2/1967 | Kennedy et al. | 604/78 |
| 4,581,013 | 4/1986 | Allen | 604/78 |

FOREIGN PATENT DOCUMENTS

| | | | |
|---|---|---|---|
| 79262 | 3/1919 | Switzerland | 604/78 |
| 283160 | 9/1952 | Switzerland | 222/129 |
| 15194 | 1/1891 | United Kingdom | 604/78 |
| 239794 | 9/1925 | United Kingdom | 604/78 |

*Primary Examiner*—James C. Yeung

*Attorney, Agent, or Firm*—Browdy & Neimark

[57] ABSTRACT

A device in connection with a cup having a cover with a drinking passage in a spout is characterized by an adapter or a holder for receiving and holding a syringe or the like, and a medicine passage extending from said adapter to the area of the outlet of the drinking passage.

2 Claims, 1 Drawing Sheet

DEVICE IN CONNECTION WITH A CUP WITH A COVER

The present invention relates to a device in connection with a cup with a cover and a drinking channel provided in a spout.

A standard drinking cup for children is of a kind that is provided with two hands, one at each side, and with a cover with a spout.

Cups of this kind contribute to avoid a mess when children drink beverages.

There is, however, a problem arising if children, or possibly other users who cannot help themselves, are prescribed a medicine to be taken with a beverage and the nature of the medicine does not permit the medicine to be taken with the beverage in the cup.

Previously, it was necessary, sometime with extrusion of mild force, to insert the medicine into the recipient's mouth and then administer a beverage to take the taste away. A situation might readily arise with the recipient spitting out the medicine, e.g. because it has an awful taste. Also, the recipient, often a child, may swallow part of the medicine the wrong way which, in fact, represents a health hazard.

It is, thus, an object of the present invention to remedy the shortcomings of the known technology and to provide an aid to make it easier to administrate medicines, especially to children.

The invention, thus, relates to a device in connection with a cup with a cover and a drinking channel in a spout, and the invention is characterized by an adapter or a holder to receive and hold a syringe, or the like, as well as a medicine passage from said adapter to the area of the outlet of said medicine passage.

In a preferred embodiment of the invention adapters and said medicine passage are shaped in one piece with said cover.

In another preferred embodiment of the invention said medicine passage opens adjacent to but separated from said drinking passage.

Figure 1:
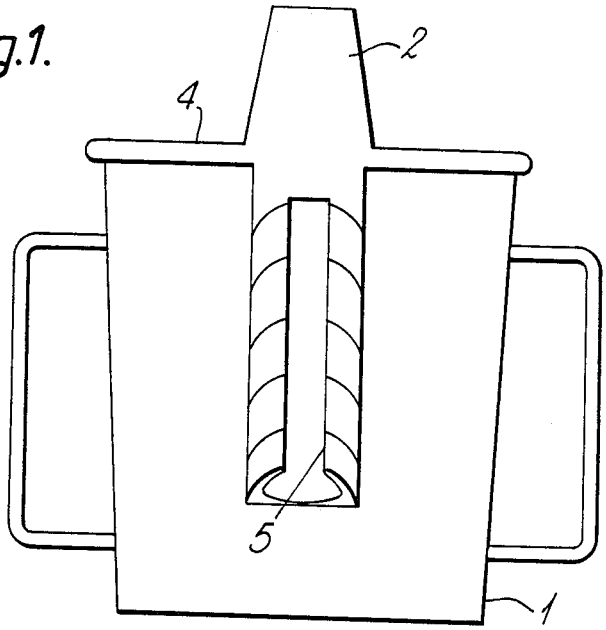
Figure 2:
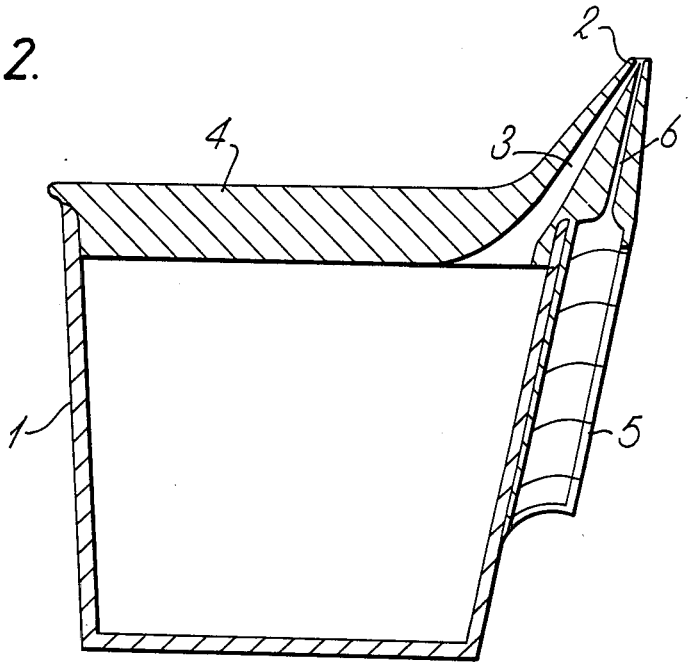

The invention is described in more detail below with reference to the accompanying drawings, wherein FIG. 1 shows the cup in a front view, and FIG. 2 is a sectional view of the cup.

In the shown and preferred embodiment cup 1, in a manner known per se, is provided with two handles or the like. Said cup is closed by a cover 4 with a spout for drinking, which has a drinking passage 3.

In the shown and preferred embodiment an adapter 5 is shown and is intended for receiving and holding a conventional syringe, not shown. The syringe is inserted into adapter 5 and is in contact with the lower end of medicine passage 6 and will be firmly held there, the wings of said adapter being shaped so as to form an opening that is slightly smaller than the syringe.

A suitable size for use is a conventional 5 ml syringe.

When medicine is to be administered, cup 1 is filled with a beverage in a conventional manner, and the syringe is filled with medicine to be administered. The syringe is then pushed into adapter 6.

When the recipient of medicine drinks, the person administering medicine can at the time release small or large doses, depending on the willingness to drink and the receiving capacity of the recipient. This may be achieved, e.g. by slight pressures on the plunger of the syringe.

With a device as disclosed above the hazard of wasting expensive medicine, and the hazard of the recipient swallowing the medicine the wrong way is reduced to a minimum, since beverage from passage 3 will rapidly transport the medicine from passage 6 through the recipient's mouth and throat into his or her stomach.

In the figures the invention is shown in a preferred embodiment with adapter 5 and medicine passage 6 shaped in one piece with cover 4. However, there is a possible embodiment with adapter 5 and passage 6 shaped in one piece with the cup, and such an embodiment is to be regarded as within the scope of the invention.

The invention is, furthermore, shown in a preferred embodiment with medicine passage 6 and drinking passage 2 opening at separate places but close to each other. This will reduce to a minimum any hazard of having beverage from cup 1 unintentionally sucked back to the not shown syringe when administration of medicine has stopped.

In the preferred embodiment covers of the disclosed kind may be produced for use with existing cups, and the invention, thus, represents a simple and inexpensive aid for use in health institutions and hospitals, and in homes for the aged, and nursing homes, generally, everywhere where administration of medicine may be difficult.

Having described my invention, I claim:

1. A device for assisting in the adminstration of liquid medicine from a syringe in conjunction with a pleasant tasting liquid from a cup, comprising a cover adapted to seal an upper open edge of a cup, said cover having a generally planar portion and a spout extending upwardly and outwardly therefrom, said spout having a drinking passage extending therethrough to an outlet end of said spout; and a holder unitary and integral with said cover and sized and shaped to receive and hold a syringe therein, said holder extending downwardly and inwardly in line with said spout so as to lie adjacent a side of the cup when said cover is placed on the cup, and a medicine passage extending from said holder into said spout and extending adjacent the drinking passage at least partway through said spout.

2. A device according to claim 1 wherein the medicine passage extends substantially entirely through said spout independent of the drinking passage.

* * * * *